US007426839B2

(12) United States Patent
Beaudry

(10) Patent No.: US 7,426,839 B2
(45) Date of Patent: Sep. 23, 2008

(54) BEVERAGE CONTAINER

(75) Inventor: Robert M. Beaudry, 5120 S. Julian Dr., Suite 110, Tucson, AZ (US) 85706

(73) Assignee: Robert M. Beaudry, Tucson, AZ (US), Trustee of the Beaudry Revocable Trust, Dated Nov. 4, 2002

( * ) Notice: Subject to any disclaimer, the term of this patent is extended or adjusted under 35 U.S.C. 154(b) by 290 days.

(21) Appl. No.: 11/267,230

(22) Filed: Nov. 3, 2005

(65) Prior Publication Data

US 2006/0053827 A1 Mar. 16, 2006

Related U.S. Application Data

(63) Continuation-in-part of application No. 10/869,323, filed on Jun. 15, 2004.

(51) Int. Cl.
*F25D 3/08* (2006.01)

(52) U.S. Cl. ..... 62/457.3; 62/457.2; 62/530

(58) Field of Classification Search ..... 62/457.3, 62/457.2, 530

See application file for complete search history.

(56) References Cited

U.S. PATENT DOCUMENTS 3,961,496 A * 6/1976 Ku ..... 62/459
6,227,004 B1 * 5/2001 Gerstein ..... 62/421
RE37,213 E 6/2001 Staggs
2003/0070446 A1 4/2003 Scullion et al.
2003/0161925 A1 8/2003 Scullion et al.
2003/0161931 A1 8/2003 Scullion et al.

FOREIGN PATENT DOCUMENTS

GB 2368113 A 4/2002

OTHER PUBLICATIONS

Frozen crystals give drinkers an alternative pint of lagel top, Financial Times, Section National News, Sep. 4, 2000.

* cited by examiner

*Primary Examiner*—Melvin Jones
(74) *Attorney, Agent, or Firm*—Ingrassia Fisher & Lorenz, P.C.

(57) ABSTRACT

An apparatus and method for cooling a beverage, through the special design of a container for dispensing a beverage, is disclosed. The beverage remains cold for a period of time while it is inside the container, through contact with a frozen substance consumable substance with a lower temperature than the beverage. The frozen substance is substantially frozen before the beverage is introduced into the container. The beverage and the frozen substance make contact through portions of a barrier structure containing the frozen substance. As the frozen substance melts, it gradually mixes with the beverage, continuing to cool the beverage over a period of time, without ice floating to the top of the container.

26 Claims, 4 Drawing Sheets

BEVERAGE CONTAINER

CLAIM TO DOMESTIC PRIORITY

The present application is a continuation-in-part of U.S. patent application Ser. No. 10/869,323 entitled "Beverage Cooling Vessel", filed on Jun. 15, 2004, by Robert Beaudry. The present application claims priority to subject matter disclosed in the prior U.S. patent application Ser. No. 10/869,323.

FIELD OF THE INVENTION

The present invention relates generally to an apparatus and method pertaining to a container capable of keeping beverages cold.

BACKGROUND OF THE INVENTION

When consuming certain beverages, such as beer, soft drinks, lemonade, iced tea, water and various other beverages, individuals prefer the beverage to be cold. However, as the beverage is served for consumption, the beverage will start to lose its cold temperature, to the displeasure of the individual consuming the beverage.

There are a number of existing methods for cooling a beverage, with each method containing its own imperfections. One can refrigerate a beverage, but the beverage will begin to rise in temperature as soon as it is removed from the refrigerator. One can also use ice cubes, but these can melt quickly into the beverage and dilute the beverage, and can reduce the enjoyment of drinking the beverage.

There are some apparatus and methods in the art capable of cooling a beverage through the use of components such as motors, cooling coils, spray nozzles, pumps, pipes, ultrasound devices or potentially harmful chemicals. However, the use of such components increases the costs of manufacturing the apparatus as well as the difficulty and costs of using and maintaining the apparatus, as such components require time and skill to use, and are likely to break down over time.

Thus, a need exists for an apparatus and method, capable of being manufactured, used and maintained easily and economically, which cools a beverage even as the beverage is served or consumed, without having ice float to the top of the container while the beverage is being served or consumed, and without the need for any motors, mechanical parts or potentially harmful chemicals to cool the beverage.

SUMMARY OF THE INVENTION

In one embodiment, the present invention is a beverage container comprising an outer wall having a bottom portion and a side portion capable of containing a beverage. A barrier structure extends up from the bottom portion of the outer wall. The barrier structure has a plurality of blocking portions for holding a frozen substance below the plurality of blocking portions and further having an open portion between adjacent ones of the plurality of blocking portions to allow the beverage to contact the frozen substance.

In another embodiment, the present invention is a beverage container comprising an outer wall having a bottom portion and a side portion capable of containing a beverage. A barrier structure is capable of attachment to the side portion of the outer wall. The barrier structure has a plurality of blocking portions for holding a frozen substance below the plurality of blocking portions and further having an open portion between adjacent ones of the plurality of blocking portions to allow the beverage to contact the frozen substance.

In another embodiment, the present invention is a beverage container comprising an outer wall having a bottom portion and a side portion capable of containing a beverage. A barrier structure is attached to the outer wall. The barrier structure has a blocking portion for holding a frozen substance below the blocking portion and further having one or more openings to allow the beverage to contact the frozen substance.

In another embodiment, the present invention is a barrier structure for use in a beverage container comprising blocking portions and open portions. The blocking portions are capable of containing a frozen substance beneath the blocking portions. The open portions are capable of permitting the beverage to contact the frozen substance.

In another embodiment, the present invention is a method of manufacture comprising providing a mold for a container capable of containing a beverage, comprising an outer wall having a bottom portion and a side portion capable of containing a beverage, and a barrier structure extending up from the outer wall, the barrier structure having a blocking portion for holding a frozen substance below the blocking portion and further having an open portion between adjacent blocking portions to allow the beverage to contact the frozen substance, filling the mold with liquid capable of hardening, allowing the liquid to substantially harden inside the mold, and removing the substantially hardened liquid from the mold.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

The present invention provides a novel apparatus and method for cooling a beverage. The invention includes a container for cooling a beverage inside a container, without ice floating to the top of the container, and without the need for any motors, other mechanical parts, or chemicals to cool the beverage.

The container contains an outer wall with a bottom portion and a side portion capable of containing a beverage. The container also contains a barrier structure extending up from the bottom portion of the outer wall. The barrier structure has a blocking portion for holding a frozen substance below the blocking portion. The barrier structure also has an open portion between adjacent blocking portions to allow the beverage to contact the frozen substance. As the frozen substance comes into contact with the beverage, the beverage can be kept cold over a period of time.

The disclosed containers and methods can take a number of different forms, with accompanying functional and/or aesthetic benefits. For example, the container can be, among various other possible embodiments, a mug, glass, stein, pitcher, can or bowl. The component parts of the container can be configured so as to allow the beverage to be cooled more quickly or over a longer a period of time, or can be otherwise customized to meet the particular functional or aesthetic needs of particular customers. Some embodiments of the container have a barrier structure that is permanently fixed to the portion of the container containing the beverage, while other embodiments contain separable parts, or rotating parts, among other variations.

A novel container and method for cooling a beverage is disclosed. The container is capable of cooling a beverage over a period of time through contact between the beverage and a frozen substance through a barrier structure. The inventive design provides a cost effective, user-friendly means of cooling a beverage without ice floating to the top of the container. Unlike the prior art, the inventive design does not require any motors, coils, spray nozzles, pumps, pipes, ultrasound emitters or potentially harmful chemicals to cool the beverage. Rather, the inventive design requires little in maintenance, and is easy for any purveyor or customer to use, maintain and clean.

Figure 1:
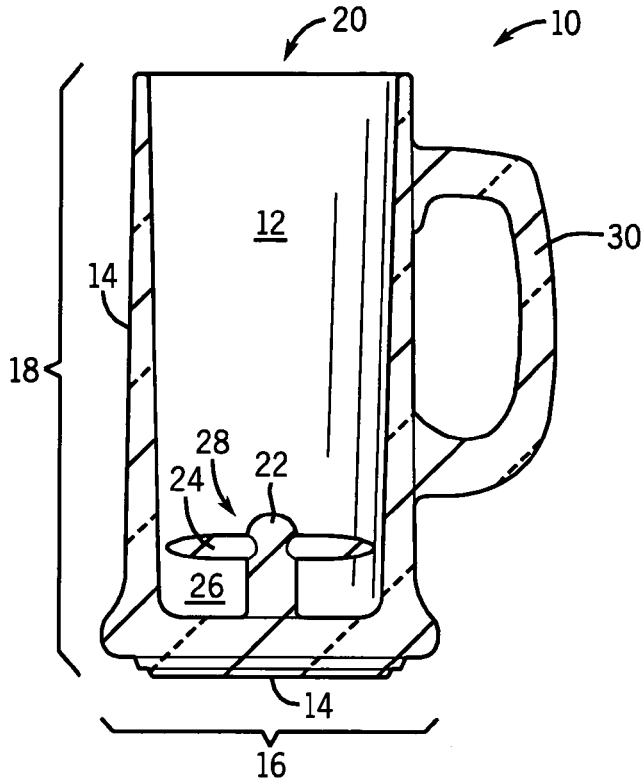
FIG. 1 is a cross-sectional view of one embodiment of the container, in the form of a mug.

FIG. 1 shows one embodiment of container 10. Container 10 is capable of being used for holding, pouring, serving, drinking or otherwise delivering a beverage 12. Container 10 can be made of material known in the art, including but not limited to glass material, plastic, pewter, silver, any other metal, or any other material, or any combination thereof.

Container 10 has an outer wall 14. The outer wall 14 has a bottom portion 16 and a side portion 18 capable of containing beverage 12. The beverage 12 may include beer, lager, wine, soft drinks, floats, lemonade, punch, flavored beverages, or any other alcoholic or non-alcoholic beverages or combinations thereof. The container 10 has an opening 20, for delivering beverage 12 for serving or consumption.

The container 10 also contains a barrier structure 22, attached to bottom portion 16. The barrier structure 22 contains a blocking portion 24 capable of containing a frozen substance 26 beneath blocking structure 24. The barrier structure 22 also has an open portion 28 capable of allowing contact between frozen substance 26 and beverage 12, thereby having a cooling effect on beverage 12.

The barrier structure 22 can be made of any material known in the art, including but not limited to glass material, plastic, pewter, silver, any other metal, or any other material, or any combination thereof. The barrier structure 22 may or not be made of the same material as other portions of container 10.

In this embodiment, barrier structure 22 is attached to bottom portion 16. In other embodiments, barrier structure 22 may be attached to side portion 18, or any other portions of outer wall 14. The barrier structure 22 may either be fixed or removable, and may be either stationary or capable of rotation or other movement.

The frozen substance 26 is placed into container 10 prior to freezing. The container 10 is then placed into an environment, such as a freezer, with a temperature known in the art to accomplish the freezing of frozen substance 26, preferably below the phase transition temperature of frozen substance 26. The container 10 is kept in such an environment until frozen substance 26 is substantially frozen. Preferably, container 10 is kept in this environment until the outer surface of frozen substance 26 is completely frozen. Most preferably, container 10 is kept in this environment until the entire frozen substance 26 is completely frozen.

After frozen substance 26 is substantially frozen inside container 10, beverage 12 is then poured or placed through opening 20, into container 10. The frozen substance 26 then contacts beverage 12 through barrier structure 22. The beverage 12 is then cooled by its proximity and contact with frozen substance 26.

As the frozen substance 26 melts, frozen substance 26 sustains for a period of time a lower temperature than beverage 12. Accordingly, frozen substance 26 is capable of continuing to cool beverage 12 as frozen substance 26 melts and mixes with beverage 12 through barrier structure 22.

The barrier structure 22 may be of any shape and size, such that barrier structure 22 allows for direct contact between some, but not all, of the upper-most layer of frozen substance 26 and the lower-most layer of beverage 12. By way of example only, barrier structure 22 in this particular embodiment is in the shape of a propeller, containing a blocking portion 24 in the shape of adjacent propeller blades. In this example, frozen substance 26 contacts beverage 12 through open portion 28 in between the adjacent propeller blades of blocking portion 24. The shape and size of barrier structure 22 and blocking portion 24 can be varied depending on aesthetic needs as well as to control the speed and duration of the cooling effect, and the ease of cleaning.

The smaller the surface area of blocking portion 24, frozen substance 26 is in greater contact with beverage 12. Accordingly, the smaller the surface area of blocking portion 24, beverage 12 will be cooled more rapidly and thoroughly. This is ideal for a beverage 12 which is meant to be consumed more quickly (such as a soft drink or performance drink), and/or for a customer who is very thirsty or in a hurry, or who otherwise prefers to consume beverage 12 more quickly.

The greater the surface area of blocking portion 24, frozen substance 26 is in less contact with beverage 12. Accordingly, the greater the surface area of blocking portion 24, beverage 12 will be cooled more gradually over a longer period of time. This is ideal for a beverage 12 which is meant to be consumed more slowly (such as wine or champagne), and/or for a customer who prefers to savor beverage 12 and/or consume beverage 12 more slowly.

The distances between blocking portion 24 and the different parts of outer wall 14 in this embodiment will also have various effects on the speed and duration of the cooling of beverage 12. For example, the farther blocking portion 24 is from bottom portion 16, there is capacity for a larger quantity of frozen substance 26, thereby allowing beverage 12 to be cooled for a longer period of time. As another example, the larger the space (if any) between blocking portion 24 and side portion 18, the larger the open portion 28 becomes, allowing beverage 12 to be cooled more quickly, but for a shorter duration of time.

The shape of barrier structure 22 and blocking portion 24 can also be varied to facilitate cleaning and maintenance, for example by leaving more space within barrier structure 22 to allow easy entry of cleaning materials. The barrier structure 22 may also be detachable in whole or in part, or may be part of a detachable portion of or complementary component for container 10, to help facilitate cleaning and maintenance.

The shape of barrier structure 22 can also be varied depending based on aesthetic reasons, or other reasons. For example, barrier structure 22 can reflect the shape or likeness of a particular letter, name or logo representing the manufacturer of beverage 12, frozen substance 26, or container 10, a restaurant, bar, amusement park, retail store or other establishment featuring container 10, a letter, name, logo or design representing a particular sport, sporting event or town, a design associated with a particular holiday or event (e.g. a four leaf clover for Saint Patrick's Day), an eye-catching design such as a face, body or any part thereof, or any other design that may be of interest to the parties manufacturing, selling, serving, purchasing or consuming container 10, beverage 12 or any associated goods or services.

In some embodiments of the container, frozen substance 26 is the same type of substance as beverage 12. This allows for beverage 12 to maintain a consistent, undiluted taste as frozen substance 26 approaches the phase transition temperature and gradually melts and mixes with beverage 12 without floating to the top.

In some embodiments of the container, frozen substance 26 is a flavoring capable of complementing or enhancing the taste of beverage 12 as frozen substance 26 approaches the phase transition temperature and gradually melts and mixes with beverage 12. The flavoring incorporated in frozen substance 26 in such embodiments may include, without limitation, any kind of fruit including but not limited to strawberry, lemon, lime, orange, raspberry, mango, or any other fruit or fruit flavorings or combinations thereof, or garnishments, or any other flavorings, or any combinations thereof.

In some embodiments of the container, as in FIG. 1, container 10 is a single, stand alone unit. In other embodiments, it is envisioned that there may be multiple removable components. For example, barrier structure 22, and/or the portion of container 10 below barrier structure 22, may be removable in whole or in part, in order to facilitate cleaning, or allow frozen substance 26 to be frozen separately, and/or for ease of manufacture an/or for cleaning, maintenance, aesthetic and/or other reasons. For example, barrier structure 22, and/or the portion of container 10 below barrier structure 22, may be separable and capable of being physically coupled with one another by one or more of a variety of means, including but not limited to by fastening, snapping, twisting, clamping, screwing or latching, or any other methods or combinations thereof.

This embodiment also contains an optional handle 30. It is envisioned that container 10 may also contain any other features such as a cap, lid, stem, multiple handles, or various other accompaniments or combinations thereof.

Figure 2:
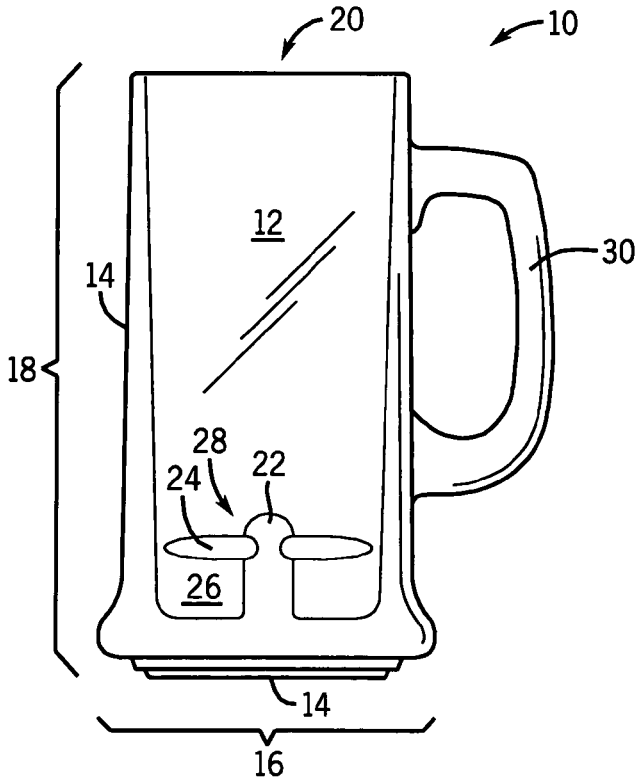
FIG. 2 is a schematic drawing of the side view of the container depicted in FIG. 1.

FIG. 2 is a schematic drawing of the side view of the container depicted in FIG. 1.

Figure 3:
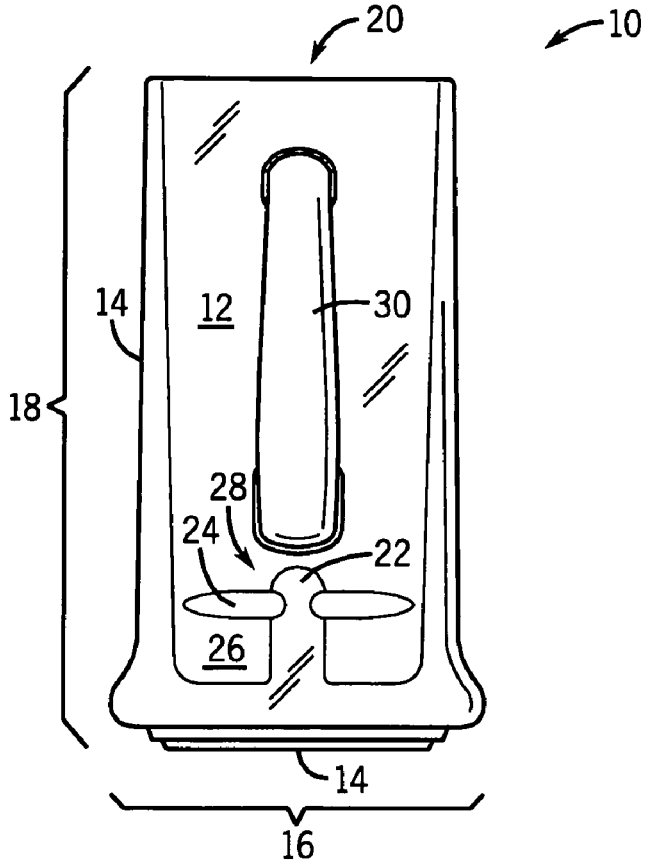
FIG. 3 is a back view of the container depicted in FIG. 1.

FIG. 3 is a back view of the container depicted in FIG. 1.

Figure 4:
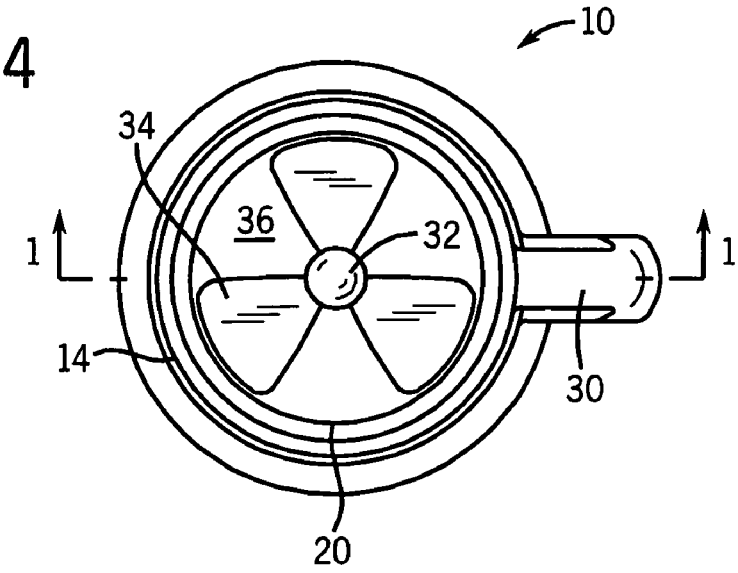
FIG. 4 is a top view of the container depicted in FIG. 1.
Figure 5A:
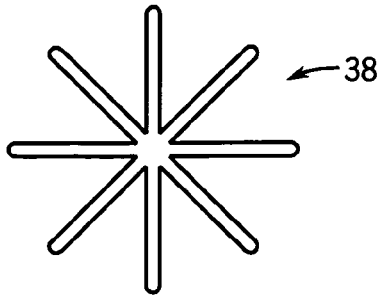
FIG. 5 presents some additional examples of various forms that can be taken by the barrier structure referenced in FIG. 1.
Figure 5B:
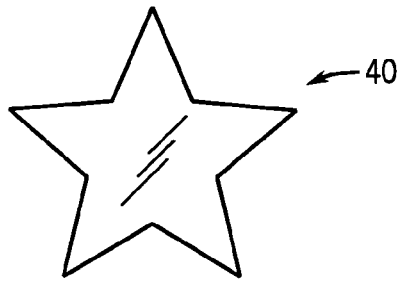
Figure 5C:
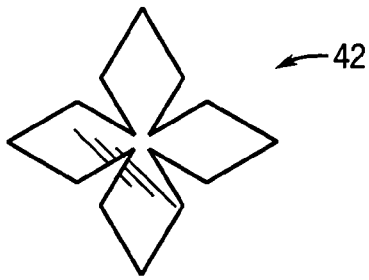
Figure 5D:
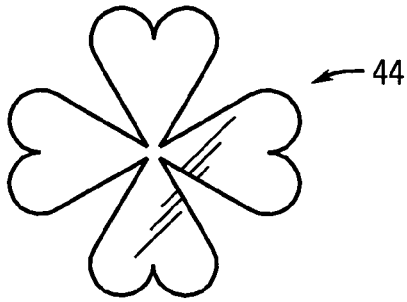
Figure 5E:
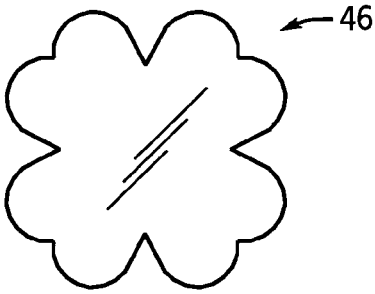
Figure 5F:
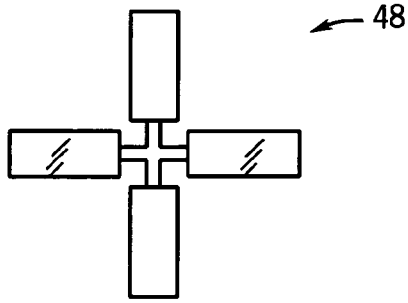
Figure 5G:
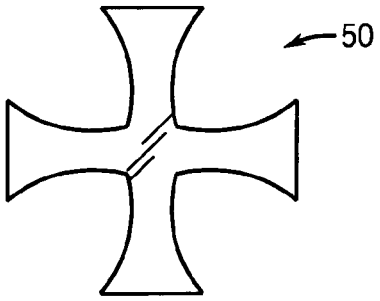
Figure 5H:
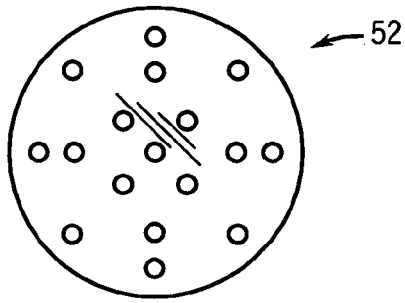

FIG. 4 is a top view of the container depicted in FIG. 1, showing one specific embodiment of barrier structure 22. By example only, barrier structure 22 in this embodiment contains a center point 32 connected to bottom portion 16.

The blocking portion 24 of barrier structure 22 in this particular embodiment contains three blades 34 that are each connected to center point 32, creating a propeller-like appearance. The blades 34 are capable of containing frozen substance 26 beneath blades 34.

The open portion 28 of in this particular embodiment contains spaces 36 in between blades 34. The frozen substance 26 contacts beverage 12 through spaces 36, thereby cooling beverage 12.

The size, shape and number of blades 34 and spaces 36 may vary in different embodiments, depending on the desired speed and duration of cooling desired, the ease of cleaning and maintenance, aesthetic considerations, and other factors. The blades 34 may also rotate to facilitate cleaning, to assist in the cooling or stirring of beverage 12 and/or frozen substance 26, or for aesthetic or other purposes.

FIG. 5 presents some additional examples of various forms that can be taken by blocking portion 24 of barrier structure 22, including, by way of example only, spokes 38, a star 40, diamonds 42, hearts 44, a four leaf clover 46, a windmill 48, a miscellaneous design 50, or a plate 52 containing holes.

Figure 6:
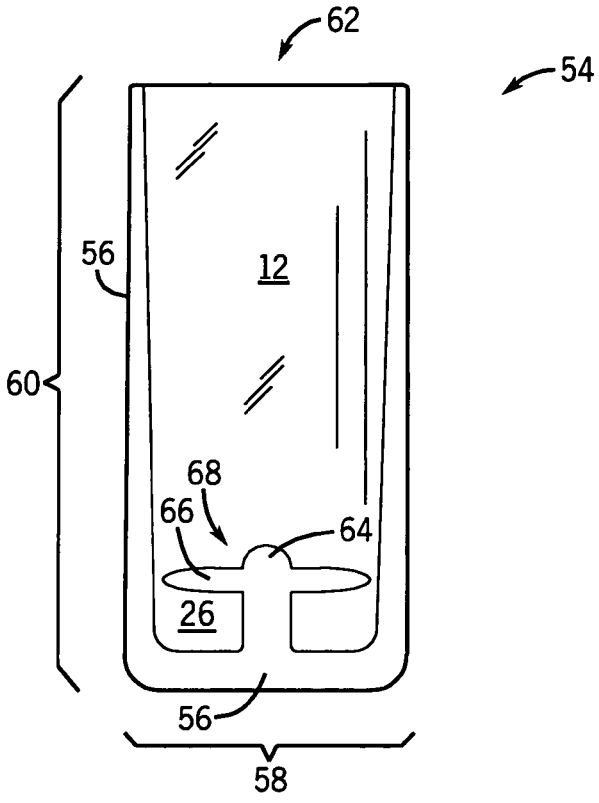
FIG. 6 shows an alternative embodiment of the container, in the form of a glass.

FIG. 6 shows an alternative embodiment of the container, in the form of a glass 54, containing an outer wall 56, a bottom portion 58, a side portion 60, an opening 62, and a barrier structure 64 with a blocking portion 66 and an open portion 68, with similar functions as their counterparts from FIG. 1 discussed above. The glass 54 allows for frozen substance 26 to cool beverage 12 in a similar manner as discussed with FIG. 1 above.

Figure 7:
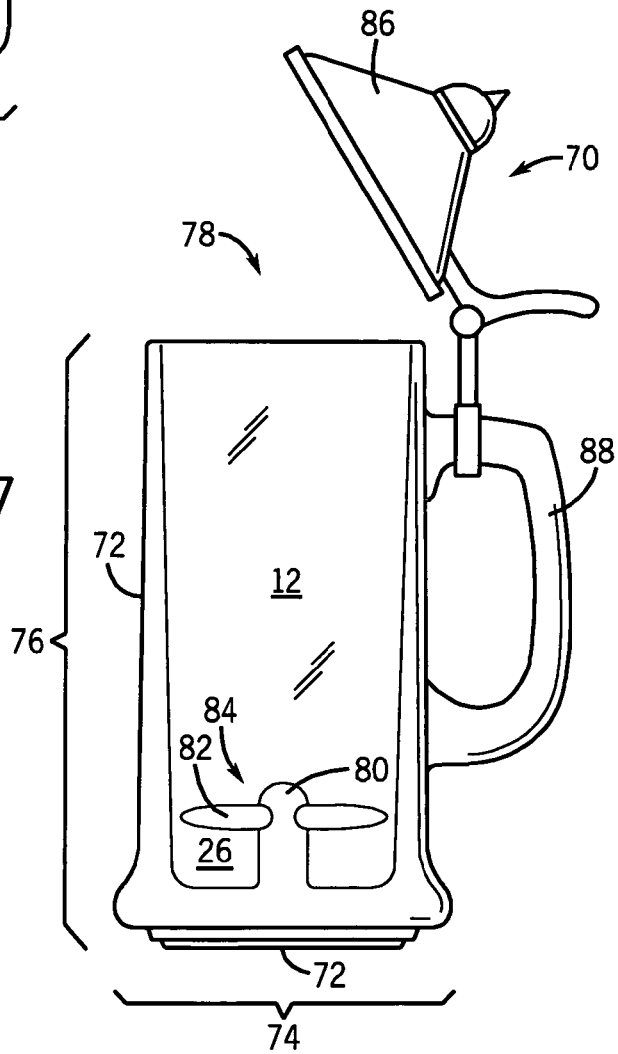
FIG. 7 shows an alternative embodiment of the container, in the form of a stein.

FIG. 7 shows another alternative embodiment of the container, in the form of a stein 70, containing an outer wall 72, a bottom portion 74, a side portion 76, an opening 78, and a barrier structure 80 with a blocking portion 82 and an open portion 84, with similar functions as their counterparts from FIG. 1 discussed above. The stein 70 allows for frozen substance 26 to cool beverage 12 in a similar manner as discussed with FIG. 1 above. The stein 70 also contains an optional lid 86 and handle 88.

Although the invention has been described in detail with reference to the presently preferred embodiments, those of ordinary skill in the art will appreciate that various modifications can be made without departing from the invention. Accordingly, the invention is defined only by the following claims.

We claim:

1. A beverage container, comprising:

an outer wall having a bottom portion and a side portion capable of containing a beverage; and a barrier structure extending up from the bottom portion of the outer wall, the barrier structure having a plurality of blocking portions for holding a frozen substance between the plurality of blocking portions and the bottom portion of the outer wall and further having an open portion between adjacent ones of the plurality of blocking portions to allow the beverage to contact the frozen substance.

2. The beverage container of claim 1, wherein the plurality of blocking portions have a flat surface.

3. The beverage container of claim 1, wherein the plurality of blocking portions are formed in the shape of a blade.

4. The beverage container of claim 1, wherein the barrier structure is rigidly attached to the bottom portion of the outer wall.

5. The beverage container of claim 1, wherein the barrier structure can rotate with respect to the bottom portion of the outer wall.

6. The beverage container of claim 1, wherein the barrier structure is removable from the bottom portion of the outer wall.

7. The beverage container of claim 1, wherein the beverage container is made of glass, plastic or metal.

8. A beverage container, comprising:

an outer wall having a bottom portion and a side portion capable of containing a beverage; and a barrier structure capable of attachment to the side portion of the outer wall, the barrier structure having a plurality of blocking portions for holding a frozen substance between the plurality of blocking portions and the bottom portion of the outer wall and further having an open portion between adjacent ones of the plurality of blocking portions to allow the beverage to contact the frozen substance.

9. The beverage container of claim 8, wherein the plurality of blocking portions have a flat surface.

10. The beverage container of claim 8, wherein the plurality of blocking portions are formed in the shape of a blade.

11. The beverage container of claim 8, wherein the barrier structure is rigidly attached to the side portion of the outer wall.

12. The beverage container of claim 8, wherein the barrier structure is removable from the side portion of the outer wall.

13. The beverage container of claim 8, wherein the beverage container is made of glass, plastic or metal.

14. A beverage container, comprising:

an outer wall having a bottom portion and a side portion capable of containing a beverage; and a barrier structure attached to the outer wall, the barrier structure having a blocking portion for holding a frozen substance below the blocking portion and further having one or more openings to allow the beverage to contact the frozen substance.

15. The beverage container of claim 14, wherein the barrier structure has a flat surface.

16. The beverage container of claim 14, wherein the barrier structure is attached to the bottom portion of the outer wall.

17. The beverage container of claim 14, wherein the barrier structure is attached to the side portion of the outer wall.

18. The beverage container of claim 14, wherein the barrier structure is removable from the outer wall.

19. The beverage container of claim 14, wherein the beverage container is made of glass, plastic or metal.

20. A barrier structure for use in a beverage container, comprising blocking portions and open portions, wherein:

the blocking portions are capable of containing a frozen substance beneath the blocking portions; and the open portions are capable of permitting the beverage to contact the frozen substance.

21. The barrier structure of claim 20, wherein the open portions are between adjacent blocking portions of the barrier structure.

22. The barrier structure of claim 20, wherein the blocking portions have a flat surface.

23. The barrier structure of claim 20, wherein the blocking portions are formed in the shape of a blade.

24. A method of manufacture, comprising:

(a) providing a mold for a container capable of containing a beverage, comprising:

an outer wall having a bottom portion and a side portion capable of containing a beverage, and a barrier structure extending up from the outer wall, the barrier structure having a blocking portion for holding a frozen substance below the blocking portion and further having an open portion between adjacent blocking portions to allow the beverage to contact the frozen substance;

(b) filling the mold with liquid capable of hardening;

(c) allowing the liquid to substantially harden inside the mold; and (d) removing the substantially hardened liquid from the mold.

25. The method of claim 24, attaching the barrier structure to the bottom portion of the outer wall.

26. The method of claim 24, attaching the barrier structure to the side portion of the outer wall.

* * * * *